United States Patent [19]

Donnelly et al.

[11] Patent Number: 4,557,584

[45] Date of Patent: Dec. 10, 1985

[54] DEVELOPMENT APPARATUS IN WHICH THE ESCAPE OF PARTICLES IS MINIMIZED

[75] Inventors: Thomas L. Donnelly, Webster; Orest Pavlovych, Rochester, both of N.Y.

[73] Assignee: Xerox Corporation, Stamford, Conn.

[21] Appl. No.: 497,947

[22] Filed: May 25, 1983

[51] Int. Cl.[4] ..... G03G 15/08

[52] U.S. Cl. ..... 355/3 DD; 355/14 D; 430/120; 118/656

[58] Field of Search ..... 15/1.5 R; 118/261, 637, 118/656-658; 355/3 DD; 430/120, 122; 250/326

[56] References Cited

U.S. PATENT DOCUMENTS

| | | | |
|---|---|---|---|
| 3,349,676 | 10/1967 | Hudson | 355/3 DD |
| 3,358,594 | 12/1967 | Thompson | 118/637 X |
| 3,496,352 | 2/1970 | Jugle | 250/326 |
| 3,659,311 | 5/1972 | Waren | 118/637 X |
| 4,067,295 | 1/1978 | Parker et al. | 355/3 DD X |
| 4,139,296 | 2/1979 | Ruckdeschel | 118/657 X |
| 4,141,645 | 2/1979 | Reid et al. | 355/3 DD |
| 4,261,290 | 4/1981 | Yamashita et al. | 355/3 DD X |
| 4,264,182 | 4/1981 | Mitchell | 355/3 DD |
| 4,279,499 | 7/1981 | Rezanke et al. | 355/3 DD |
| 4,324,483 | 4/1982 | Tagawa et al. | 355/3 DD |
| 4,330,193 | 5/1982 | Stange | 355/3 DD |
| 4,368,970 | 1/1983 | Hays | 355/3 DD |
| 4,373,798 | 2/1983 | Tsukada et al. | 355/3 DD |
| 4,394,086 | 7/1983 | Hoffman, Jr. et al. | 355/3 DD X |
| 4,417,802 | 11/1983 | Forbes, II | 430/120 X |
| 4,439,034 | 3/1984 | Daniels | 355/3 DD |

*Primary Examiner*—A. C. Prescott
*Assistant Examiner*—Terrance L. Flower
*Attorney, Agent, or Firm*—Henry Fleischer; John E. Beck; Ronald Zibelli

[57] ABSTRACT

An apparatus which develops a latent image with marking particles transported from a storage supply into contact therewith. As the marking particles are moved into contact with the latent image, extraneous marking particles are confined and guided gently back to the storage supply thereof. In this way, any clouds of particles formed cannot escape from the development apparatus.

8 Claims, 3 Drawing Figures

DEVELOPMENT APPARATUS IN WHICH THE ESCAPE OF PARTICLES IS MINIMIZED

This invention relates generally to an electrophotographic printing machine, and more particularly concerns an apparatus for developing a latent image while minimizing the escape of particles therefrom.

Generally, an electrophotographic printing machine includes a photoconductive member which is charged to a substantially uniform potential to sensitize the surface thereof. The charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. This forms a powder image on the photoconductive member which is subsequently transferred to a copy sheet. Finally, the copy sheet is heated to permanently affix the powder image thereto in image configuration.

Frequently, the developer material is made from a mixture of carrier granules and toner particles. The toner particles adhere triboelectrically to the carrier granules. This two-component mixture is brought into contact with the latent image. Toner particles are attracted from the carrier granules to the latent image forming the powder image thereof. In a typical magnetic brush development system, a developer roller advances a supply of developer material into contact with the latent image. A trim blade is employed to control the height or thickness of the developer material being advanced on the developer roller into contact with the latent image. Toner particles escaping from the developer housing have frequently resulted in serious contamination problems throughout the printing machine. This is a costly problem requiring frequent maintenance of the machine. The toner particles emitted from the developer housing may escape as clouds. It has been found that one of the largest sources of toner particle clouds occurs directly under the trim blade. Developer material moving at high velocity is driven along the underside of the trim blade and downwardly therefrom in a shower effect which creates an enormous powder cloud. These airborne toner particles are then pumped out of the developer housing cavity through the trim zone onto the various other subsystems within the electrophotographic printing machine. Thus, it is highly desirable to eliminate the formation of the toner powder cloud as a means of significantly reducing toner particle contamination throughout the printing machine. Various approaches have been devised for controlling the flow of developer material. The following disclosures appear to be relevant:

U.S. Pat. No. 3,358,594 Patentee: Thompson, Issued: Dec. 19, 1967.

U.S. Pat. No. 3,659,311 Patentee: Waren, Issued: May 2, 1972.

The pertinent portions of the foregoing disclosures may be briefly summarized as follows:

Thompson describes a doctor blade which removes particles remaining on an applicator roll. The particles move downwardly along the upper side of the doctor blade onto suitable chutes or baffles which direct the flow of material to the interior of the applicator roll. A plurality of vanes are arranged in the interior of the roll to mix and direct particles transversely along the interior of the roll and into the bin.

Waren describes a non-magnetic ledge extending tangentially from the outer surface of a tube and curving downwardly and outwardly therefrom. A magnetic rotor is located inside the tube. As the magnetic rotor rotates, powder adhering to the surface of the drum is attracted onto the tube. The powder moves around the surface of the tube onto the ledge. Then, under the influence of gravity, the powder slides down the ledge and falls into a trough.

In accordance with the features of one aspect of the present invention, there is provided an apparatus for developing a latent image. The apparatus includes means for storing a supply of marking particles. Means transport the marking particles from the storing means into contact with the latent image so as to develop the latent image. Means remove the marking particles from the transporting means to control the amount of marking particles being transported into contact with the latent image. Means, positioned to receive the marking particles removed from the transporting means by the removing means, guide gently and contain the marking particles flowing from the removing means to the storing means. In this way, any clouds of particles formed cannot escape from the apparatus.

Pursuant to another aspect of the present invention, there is provided an electrophotographic printing machine of the type having an electrostatic latent image recorded on a photoconductive surface. The printing machine includes means for storing a supply of marking particles. Means transport the marking particles from the storing means into contact with the latent image so as to develop the latent image. Means remove the marking particles from the transporting means to control the amount of marking particles being transported into contact with the latent image. Means, positioned to receive the marking particles removed from the transporting means by the removing means, guide gently and contain the marking particles flowing from the removing means to the storing means so that any clouds of particles formed cannot escape therefrom.

Other aspects of the present invention will become apparent as the following description proceeds and upon reference to the drawings, in which.

While the present invention will hereinafter be described in connection with a preferred embodiment thereof. It will be understood that it is not intended to limit the invention to that embodiment. On the contrary, it is intended to cover all alternatives, modifications and equivalents as may be included in the spirit and scope of the invention as defined by the appended claims.

Figure 1:
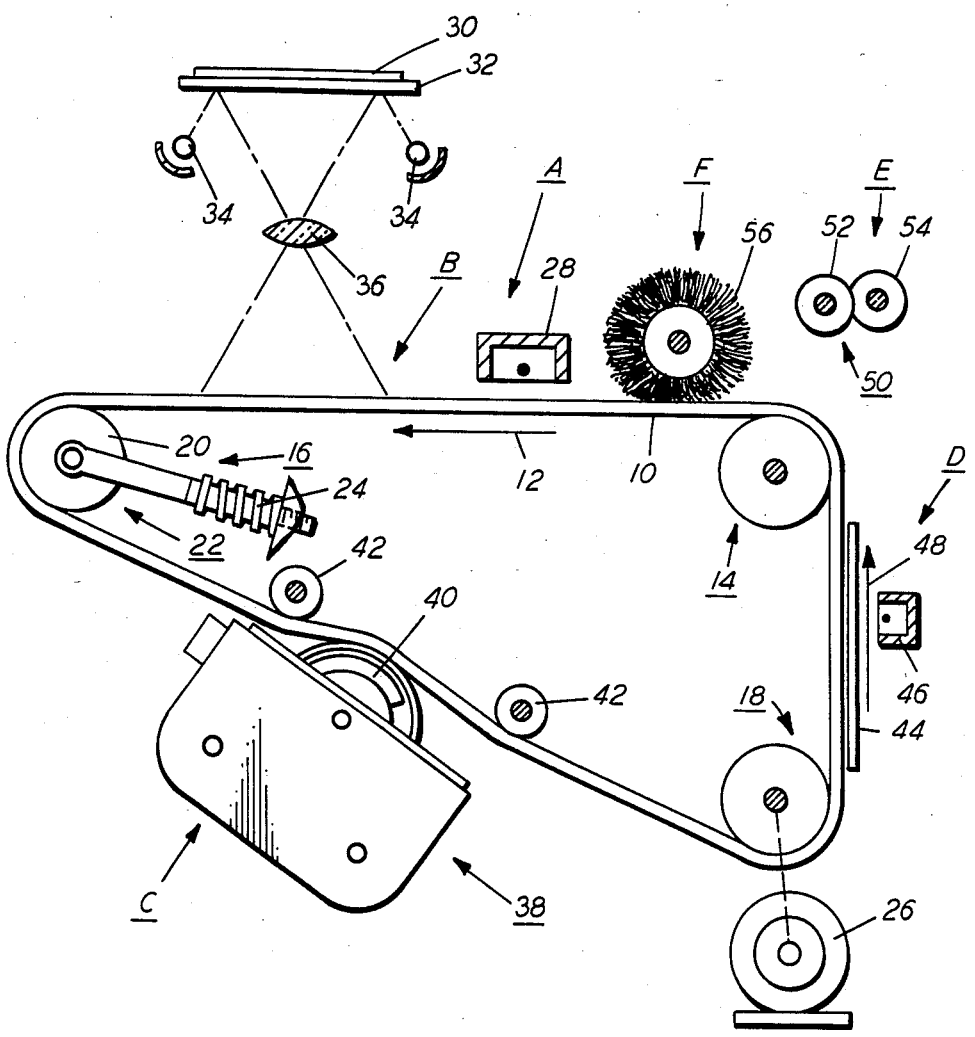
FIG. 1 is a schematic elevational view depicting an electrophotographic printing machine incorporating the features of the present invention therein.

For a general understanding of the illustrative electrophotographic printing machine incorporating the features of the present invention therein, reference is made to the drawings. In the drawings, like reference numerals have been used throughout to designate identical elements. FIG. 1 schematically depicts the various components of an electrophotographic printing machine employing the development system of the present invention therein. Although this development system is particularly well adapted for use in the illustrative electrophotographic printing machine, it will become evident from the following discussion that it is equally well suited for use in a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a belt 10 having a photoconductive surface deposited on a conductive substrate. Preferably, the photoconductive surface is made from a selenium alloy. The conductive substrate is made preferably from aluminum which is electrically grounded. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16, and drive roller 18. As shown in FIG. 1, tensioning system 16 includes a roller 20 over which belt 10 moves. Roller 20 is mounted rotatably in yoke 22. Spring 24, which is initially compressed, resiliently urges yoke 22 in a direction such that roller 20 presses against belt 10. The level of tension is relatively low permitting belt 10 to be easily deflected. The detailed structure of the tensioning system will be described hereinafter with reference to FIG. 2. With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned facedown upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30.

Thereafter, belt 10 advances the electrostatic latent image recorded on the photoconductive surface to development station C. At development station C, a magnetic brush development system, indicated generally by the reference numeral 38 advances developer material into contact with the electrostatic latent image. Preferably, magnetic brush development system 38 includes a developer roller 40. Developer roller 40 transports a brush of developer material comprising magnetic carrier granules and toner particles into contact with belt 10. As shown in FIG. 1, developer roller 40 is positioned such that the brush of developer material deforms belt 10 between idler rollers 42 in an arc with belt 10 conforming, at least partially, to the configuration of the developer material. The thickness of the layer of developer material adhering to developer roller 40 is controlled. The electrostatic latent image attracts the toner particles from the carrier granules forming a toner powder image on the photoconductive surface of belt 10. The detailed structure of magnetic brush development system 38 will be described hereinafter with reference to FIG. 3.

After development, belt 10 advances the toner powder image to transfer station D. At transfer station D, a sheet of support material 44 is moved into contact with the toner powder image. Sheet 44 is advanced to transfer station D by a sheet feeding apparatus (not shown). Preferably, the sheet feeding apparatus includes a feed roll contacting the uppermost sheet of a stack of sheets. The feed roll rotates so as to advance the uppermost sheet from the stack of sheets into a chute. The chute directs the advancing sheet of support material into contact with the photoconductive surface 10 in a timed sequence so that the toner powder image developed thereon contacts the advancing sheet of support material at transfer station D.

Transfer station D includes a corona generating device 46 which sprays ions onto the back side of sheet 44. This attracts the toner powder image from the photoconductive surface to sheet 44. After transfer, sheet 44 moves in the direction of arrow 48 onto a conveyor (not shown) which advances sheet 44 to fusing station.

Fusing station E includes a fuser assembly, indicated generally by the reference numeral 50, which permanently affixes the transferred toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. In this manner, the toner powder image is permanently affixed to sheet 44. After fusing, a chute guides the advancing sheet 44 to a catch tray for subsequent removal from the printing machine by the operator.

Invariably, after the sheet of support material is separated from the photoconductive surface of belt 10, some residual particles remain adhering thereto. These residual particles are removed from the photoconductive surface at cleaning station F. Cleaning station F includes a rotatably mounted fibrous brush 56 in contact with the photoconductive surface. The particles are cleaned from the photoconductive surface by the rotation of brush 56. Subsequent to cleaning, a discharge lamp (not shown) floods photoconductive surface 12 with light to dissipate any residual electrostatic charge remaining thereon prior to the charging thereof for the next successive imaging cycle.

Figure 2:
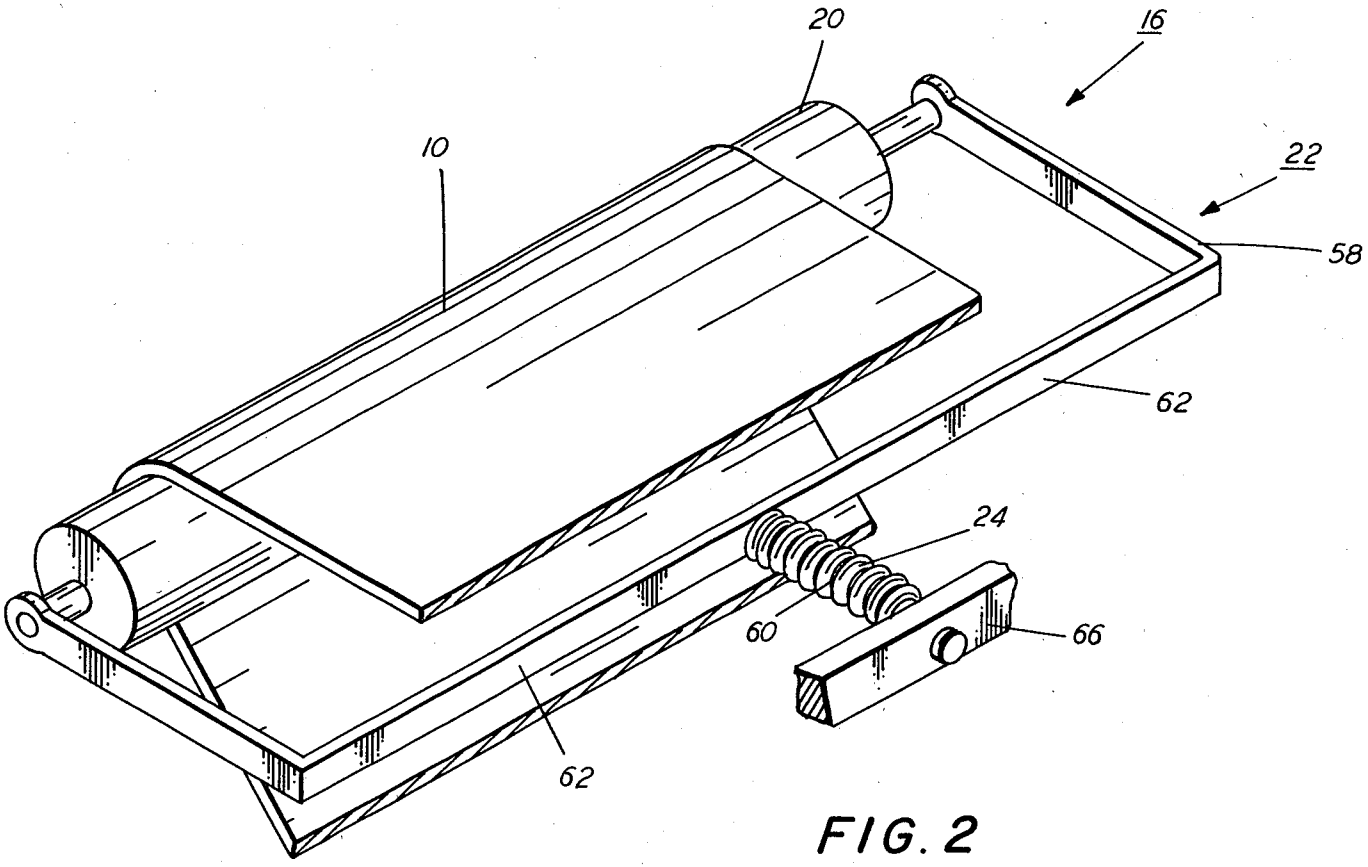
FIG. 2 is a fragmentary, perspective view showing the belt tensioning arrangement for the FIG. 1 printing macnine.

Referring now to FIG. 2, there is depicted tensioning system 16 in greater detail. As shown thereat, tensioning system 16 includes roller 20 having belt 10 passing thereover. Roller 20 is mounted in suitable bearings in a yoke, indicated generally by the reference numeral 22. Preferably, yoke 22 includes a U-shaped member 58 supporting roller 20 and a rod 60 secured to the midpoint of cross member 62 of U-shaped member 58. A coil spring 64 is wrapped around rod 60. Rod 60 is mounted slidably in the printing machine frame 66. Coil spring 24 is compressed between cross member 62 and frame 66. Spring 24 resiliently urges yoke 22 and, in turn, roller 20 against belt 10. Spring 24 is designed to have the appropriate spring constant such that when placed under the desired compression, belt 10 is tensioned to about 0.1 killograms per linear centimeter. Belt 10 is maintained under a sufficiently low tension to enable the developer material on developer roll 40 to deform belt 10 through an arc ranging from about 10° to about 40°.

Figure 3:
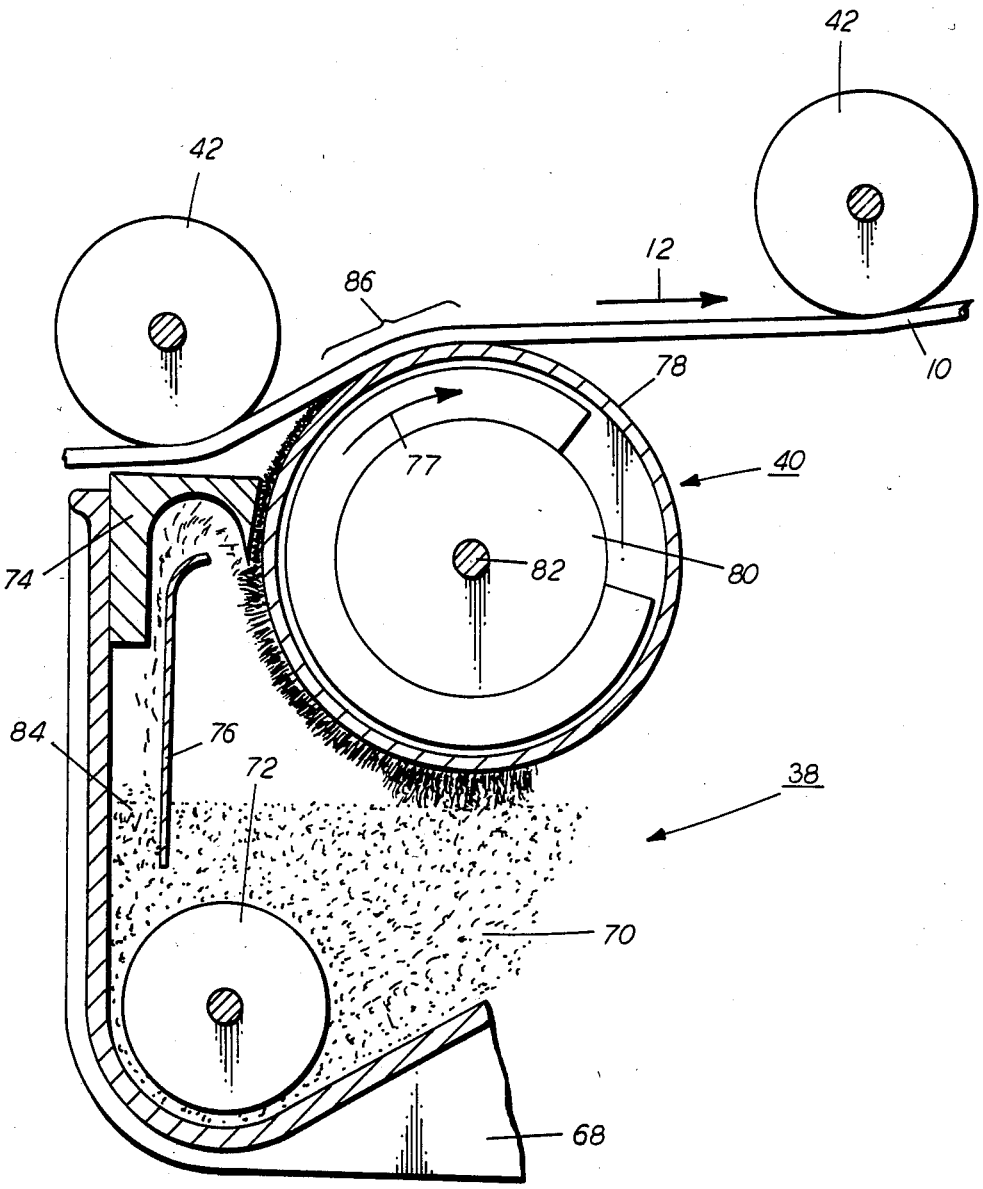
FIG. 3 is an elevational view illustrating the development system used in the FIG. 1 printing machine.

Turning now to FIG. 3, the detailed structure of development system 38 will be described. As shown therein, a fragmentary sectional elevational view depicts the essential portions of development system 38. Development system 38 includes a housing 68 defining a chamber 70 for storing a supply of developer material therein. An auger 72 mixes the developer material in chamber 70 of housing 68. Developer roller 40 advances the developer material into contact with the electrostatic latent image recorded on photoconductive belt 10. A trim bar 74 regulates the thickness of the developer pile height on developer roller 40. The tangential velocity of developer roller 40 is in the same direction and about two to three times the magnitude of the velocity of belt 10. The compressed pile height of the developer material ranges from about 0.50 centimeters to about 0.80 centimeters. As developer roller 40 rotates in the direction of arrow 77, trim bar 74 shears the extraneous developer material therefrom. The developer material continues to move along the underside of trim bar 74 due to the velocity thereof. It is then guided by baffle 76 onto auger 72 for remixing with the developer material in chamber 70 of housing 68. Baffle 76, in conjunction with the side wall of housing 68 defines a chute 84 which contains and gently guides the developer material moving along the underside of trim bar 74 downwardly onto auger 72. Baffle 76 is spaced from developer roller 40 and positioned so that substantially all of the developer material moving along the underside of trim bar 74 is received in chute 84. The level of the developer material in chamber 70 must be higher than the bottom of baffle 76 to form the desired seal. This prevents the escape of any toner powder clouds through the gap between trim bar 74 and photoconductive belt 10. By way of example, baffle 76 is made from sheet metal. In this manner, contamination from escaping toner particles is significantly reduced and the resultant performance and life of the copying machine greatly enhanced.

Developer roller 40 includes a tubular member 78 disposed rotatably about an elongated magnet 80 positioned concentrically there within and mounted on shaft 82. Tubular member 78 rotates in the direction of arrow 77. Preferably, magnet 80 extends about 300° with the exit zone being devoid of magnetic material so as to permit the developer material to fall from tubular member 78 and return to chamber 70 of housing 68 for subsequent reuse.

Preferably, tubular member 78 is electrically biased by a voltage source (not shown) to a suitable polarity and magnitude. The voltage level is intermediate that of the background voltage level and the image voltage level recorded on the photoconductive surface of belt 10. By way of example, voltage source electrically biases tubular member 78 to a voltage ranging from about 100 volts to about 500 volts. As tubular member 78 rotates at a constant angular velocity, a brush of developer material is formed on the peripheral surface thereof. The height of this brush of developer material is controlled by trim bar 74. The extraneous developer material is sheared therefrom and advanced along the underside of trim bar 74. As the extraneous developer material advances along the underside of trim bar 74, it is received in a chute 84 defined by baffle 76 and the side wall of housing 68. Chute 84 contains the developer material and gently guides it onto auger 72 for mixing with the residual developer material remaining in chamber 70 of housing 68. The developer material remaining on tubular member 78 advances into contact with belt 10 in development zone 86. The brush of developer material in development zone 86 deforms belt 10. Magnet 80 is mounted stationarily on shaft 82 to attract the developer material to tubular member 78 due to the magnetic properties of the carrier granules having the toner particles adhering triboelectrically thereto. In the development zone, these toner particles are attracted from the carrier granules to the latent image so as to form a toner powder image on the photoconductive surface of belt 10.

In recapitulation, it is clear that the development apparatus of the present invention includes a chute for receiving the developer material sheared from the developer roller and moving along the underside of a trim bar. This chute contains the extraneous developer material and gently guides it back to the storage chamber for subsequent reuse. In this way, the chute minimizes the formation of and prevents the escape of any clouds of toner particles formed. Since toner particles are prevented from escaping the development apparatus, contamination within the printing machine is significantly reduced resulting in extended life, higher reliability and better copy quality.

It is, therefore, evident that there has been provided in accordance with the present invention, an apparatus for developing an electrostatic latent image which minimizes the formation of toner powder clouds and prevents the escape thereof from the development system. This apparatus fully satisfies the advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for developing a latent image, including:

means for storing a supply of marking particles;

means for transporting marking particles from said storing means into contact with the latent image so as to develop the latent image;

a blade member positioned closely adjacent to said transporting means with the free end portion of said blade defining a gap therebetween so that said blade member removes extraneous marking particles from said transporting means with the marking particles removed from said transporting means moving along the underside of said blade member; and a chute having one open end thereof positioned to receive the marking particles moving along the underside of said blade member and the other end thereof arranged to discharge the marking particles onto the marking particles in said storing means, said chute being spaced from said transporting means and, in conjunction with said blade member, confining the marking particles to prevent the escape of a cloud of particles from the apparatus.

2. An apparatus according to claim 1, wherein said transporting means includes:

a tubular member journaled for rotary movement;

means for attracting the marking particles to said tubular member; and means for rotating said tubular member to transport the marking particles into contact with the latent image.

3. An apparatus according to claim 2, wherein:

said tubular member is non-magnetic; and said attracting means includes an elongated magnet disposed interiorly of and spaced from said tubular member.

4. An electrophotographic printing machine of the type having an electrostatic latent image recorded on a photoconductive member, wherein the improvement includes:

means for storing a supply of marking particles;

means for transporting marking particles from said storing means into contact with the latent image so as to develop the latent image;

a blade member positioned closely adjacent to said transporting means with the free end portion of said blade defining a gap therebetween so that said blade member removes extraneous marking particles from said transporting means with the marking particles removed from said transporting means moving along the underside of said blade member; and a chute having one open end thereof positioned to receive the marking particles moving along the underside of said blade member and the other end thereof arranged to discharge the marking particles onto the marking particles in said storing means, said chute being spaced from said transporting means and, in conjunction with said blade member confining the marking particles to prevent the escape of a cloud of particles from said storing means.

5. A printing machine according to claim 4, wherein said transporting means includes:

a tubular member journaled for rotary movement;

means for attracting the marking particles to said tubular member; and means for rotating said tubular member to transport the marking particles into contact with the latent image.

6. A printing machine according to claim 7, wherein:

said tubular member is non-magnetic; and said attracting means includes an elongated magnet disposed interiorly of and spaced from said tubular member.

7. A printing machine according to claim 6, wherein the photoconductive member is a flexible belt.

8. A printing machine according to claim 7, further including means for maintaining said flexible belt at a preselected tension of sufficient magnitude so that the marking particles being transported into contact therewith deflect said flexible member to wrap about a portion of the exterior surface of said transporting means to form an extended development zone.

* * * * *